US007217885B2

(12) United States Patent
Mhetar et al.

(10) Patent No.: US 7,217,885 B2
(45) **Date of Patent: *May 15, 2007**

(54) COVERING FOR CONDUCTORS

(75) Inventors: Vijay R. Mhetar, Slingerlands, NY (US); Vijay Rajamani, Slingerlands, NY (US); Kristopher Rexius, Waterford, MI (US); Sho Sato, Utsunomiya (JP); Xiangyang Tai, Utsunomiya (JP)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/256,825

(22) Filed: Oct. 24, 2005

(65) Prior Publication Data

US 2006/0131050 A1 Jun. 22, 2006

Related U.S. Application Data

(60) Provisional application No. 60/654,247, filed on Feb. 18, 2005, provisional application No. 60/637,406, filed on Dec. 17, 2004, provisional application No. 60/637,008, filed on Dec. 17, 2004, provisional application No. 60/637,412, filed on Dec. 17, 2004, provisional application No. 60/637,419, filed on Dec. 17, 2004.

(51) Int. Cl.
*H01B 7/34* (2006.01)

(52) U.S. Cl. ..... 174/110 R; 174/36; 174/120 R

(58) Field of Classification Search ..... 174/36, 174/110 R, 110 SR, 110 N, 110 FC, 110 E, 174/120 R, 120 C, 120 AR, 120 SR, 126.1–126
See application file for complete search history.

(56) References Cited

U.S. PATENT DOCUMENTS

| | | | | |
|---|---|---|---|---|
| 2,933,480 | A | 4/1960 | Gresham | 526/336 |
| 3,093,621 | A | 6/1963 | Gladding | 526/282 |
| 3,211,709 | A | 10/1965 | Odamek et al. | 526/283 |
| 3,646,168 | A | 2/1972 | Barrett | 260/889 |
| 3,790,519 | A | 2/1974 | Wahlborg | 260/28.5 AS |
| 3,884,993 | A | 5/1975 | Gros | 525/211 |
| 3,894,999 | A | 7/1975 | Boozer et al. | 526/282 |
| 4,059,654 | A | 11/1977 | Von Bodugen et al. | 524/525 |
| 4,166,055 | A | 8/1979 | Lee | 524/141 |
| 4,239,673 | A | 12/1980 | Lee | 524/141 |
| 4,383,082 | A | 5/1983 | Lee | 525/92 D |
| 4,584,334 | A | 4/1986 | Lee et al. | 524/151 |
| 4,760,118 | A | 7/1988 | White et al. | 525/397 |
| 4,952,630 | A * | 8/1990 | Morgan et al. | 525/72 |

(Continued)

FOREIGN PATENT DOCUMENTS

EP 0329423 8/1989

(Continued)

OTHER PUBLICATIONS

Japanese Patent No. JP 09241446 published Sep. 16, 1997, abstract only.

(Continued)

*Primary Examiner*—William H. Mayo, III
(74) *Attorney, Agent, or Firm*—Cantor Colburn LLP

(57) ABSTRACT

The covering for used with a conductor having a thermoplastic composition. The thermoplastic composition has a poly(arylene ether), a polyolefin and a polymeric compatibilizer. The thermoplastic composition may further have a flame retardant.

31 Claims, 1 Drawing Sheet

U.S. PATENT DOCUMENTS

| | | | | |
|---|---|---|---|---|
| 4,990,558 | A | 2/1991 | DeNicola et al. | 174/504 |
| 5,034,459 | A * | 7/1991 | Haaf et al. | 525/68 |
| 5,132,629 | A | 7/1992 | Clinton et al. | 324/544 |
| 5,166,264 | A | 11/1992 | Lee et al. | 525/92 D |
| 5,258,455 | A | 11/1993 | Laughner et al. | 414/68 |
| 5,262,480 | A | 11/1993 | Lee | 525/92 D |
| 5,294,655 | A * | 3/1994 | Lee et al. | 524/265 |
| 5,302,904 | A | 4/1994 | Nopper | 324/536 |
| 5,364,898 | A | 11/1994 | Lee et al. | 524/265 |
| 5,397,822 | A | 3/1995 | Lee | 524/127 |
| 5,416,419 | A | 5/1995 | Witt | 324/551 |
| 5,455,292 | A | 10/1995 | Kakegawa et al. | 524/141 |
| 5,612,624 | A | 3/1997 | Clinton | 324/551 |
| 6,045,883 | A | 4/2000 | Akiyama et al. | 174/110 R |
| 6,184,691 | B1 | 2/2001 | Prough | 324/551 |
| 6,306,978 | B1 | 10/2001 | Braat et al. | 525/397 |
| 6,495,630 | B2 * | 12/2002 | Adedeji et al. | 525/89 |
| 6,610,442 | B2 | 8/2003 | Ooi et al. | 428/653 |
| 6,627,701 | B2 | 9/2003 | Adedeji et al. | |
| 6,646,205 | B2 | 11/2003 | Hase et al. | 174/110 |
| 2001/0053820 | A1 * | 12/2001 | Yeager et al. | 525/186 |
| 2002/0035206 | A1 | 3/2002 | Kurasawa et al. | 525/132 |
| 2002/0112875 | A1 * | 8/2002 | Hase et al. | 174/120 C |
| 2003/0036602 | A1 * | 2/2003 | Adedeji et al. | 525/88 |
| 2003/0096123 | A1 * | 5/2003 | Yeager | 428/461 |
| 2004/0016503 | A1 | 1/2004 | Stowe | 156/244.12 |
| 2004/0082719 | A1 * | 4/2004 | Adedeji et al. | 525/89 |
| 2004/0102551 | A1 * | 5/2004 | Sato et al. | 524/115 |
| 2004/0106750 | A1 * | 6/2004 | Yeager et al. | 525/502 |
| 2004/0122153 | A1 * | 6/2004 | Guo et al. | 524/430 |
| 2004/0171733 | A1 * | 9/2004 | Balfour et al. | 524/494 |
| 2004/0177993 | A1 | 9/2004 | Nagai et al. | |
| 2004/0214952 | A1 * | 10/2004 | Kannan et al. | 525/133 |
| 2004/0260036 | A1 * | 12/2004 | Fishburn | 525/474 |

FOREIGN PATENT DOCUMENTS

| | | |
|---|---|---|
| EP | 0362660 | 4/1990 |
| EP | 0369814 | 5/1990 |
| EP | 0379286 | 7/1990 |
| EP | 0467113 | 1/1992 |
| EP | 0413972 | 2/1994 |
| EP | 0639620 | 4/1999 |
| JP | 11-185532 | 7/1989 |
| JP | 02-133462 | 5/1990 |
| JP | 2003-226792 | 10/1991 |
| JP | 06-009828 | 1/1994 |
| JP | 06-057130 | 3/1994 |
| JP | 07-166026 | 6/1995 |
| JP | 07-224193 | 8/1995 |
| JP | 09-048883 | 2/1997 |
| JP | 09-241446 | 9/1997 |
| JP | 11-209534 | 8/1999 |
| JP | 2003-253066 | 9/2003 |
| JP | 2003-261760 | 9/2003 |
| WO | WO 9701600 | 1/1997 |
| WO | WO 2000015680 | 3/2000 |
| WO | WO 2001092410 | 2/2001 |
| WO | WO 2003025064 | 3/2003 |
| WO | 8900756 | 1/2007 |

OTHER PUBLICATIONS

Japanese Patent No. JP 09048883 published Feb. 18, 1997, abstract only.
Japanese Patent No. JP 07166026 published Jun. 27, 1995, abstract only.
Japanese Patent No. JP 06057130 published Mar. 1, 1994, abstract only.
Japanese Patent No. JP 2003261760 published Sep. 19, 2003, abstract only.
Japanese Patent No. JP 11209534 published Aug. 3, 1999, abstract only.
Japanese Patent No. JP 11185532 published Jul. 9, 1999, machine translation.
Japanese Patent No. JP 07224193 published Aug. 22, 1995, machine translation.
Japanese Patent No. JP 06009828 published Jan. 18, 1994, abstract only.
Japanese Patent No. JP 02133462 published May 22, 1190, abstract only.
Japanese Patent No. JP 3220231 published Oct. 22, 2001, manual translation.
Japanese Patent No. JP 3267146 published Mar. 18, 2002, manual translation.
Japanese Patent No. JP 3418209 published Jun. 16, 2003, manual translation.
Japanese Patent No. JP 3457042 published Oct. 14, 2003, manual translation.
Japanese Patent No. JP 2003253066 published Sep. 10, 2003, machine translation.
Carroll, David "How to choose the best spark tester for your application: AC vs. DC" Clinton Instrument Company, 2 pages.
"High Voltage Pinhole Detection Technology" Clinton Instrument Company, 2 pages.
Clinton, Henry "Grounding of conductors during the spark test" Clinton Instrument Company, 2 pages.
"Digital High Frequency Sine Wave Spark Tester" Clinton Instrument Company, 2pages.
"Seven Steps to a Good Spark Test" Spark Test News, Jan. 2002, Clinton Instrument Company, 2 pages.
U.S. Appl. No. 11/256,765, filed Oct. 24, 2005, Mhetar et al.
U.S. Appl. No. 11/256,766, filed Oct. 24, 2005, Guo et al.
U.S. Appl. No. 11/256,827, filed Oct .24, 2005, Kubo et al.
U.S. Appl. No. 11/256,833, filed Oct. 24, 2005, Mhetar et al.
U.S. Appl. No. 11/257,430, filed Oct. 24, 2005, Kubo et al.
U.S. Appl. No. 11/256,834, filed Oct. 24, 2005, Mhetar et al.
U.S. Appl. No. 11/256,826, filed Oct. 24, 2005, Mhetar et al.

* cited by examiner

COVERING FOR CONDUCTORS

CROSS REFERENCE TO RELATED APPLICATIONS

This application claims priority to U.S. Provisional Application Ser. Nos. 60/637,406, 60/637,008, 60/637,412, and 60/637,419 filed on Dec. 17, 2004, and U.S. Provisional Application Ser. No. 60/654,247, filed on Feb. 18, 2005, all of which are incorporated in their entirety by reference herein.

BACKGROUND OF INVENTION

Electrical wire has been used in a wide variety of applications. In many applications the conductor is surrounded by an electrically insulating thermoplastic covering. While many of the requirements for the insulating thermoplastic covering vary with how and where the electrical wire will be used, most applications, particularly high voltage applications such as automotive underhood applications, require that the insulating thermoplastic covering be free of spark leaks. Spark leaks are caused by imperfections, such as pinholes, in the insulating covering surrounding the wire. In the production of electrical wire for automotive applications the electrical wire is tested for spark leaks and when a spark leak is found the wire is cut and the section containing the spark leak is discarded. The presence of spark leaks during manufacture interrupts the continuity of the wire and decreases productivity. Because the wire is cut to remove the section containing the spark leak multiple lengths of wire result. These lengths are typically combined to form an overall total length that is packaged and sold.

Electrical wire is typically sold on spools or in containers containing a total amount of wire length determined in part by the cross-sectional area of the conductor. The electrical wire is removed from the spool or container for use in various articles such as automotive wiring harnesses. For example, an electrical wire having a conductor cross-sectional area of 0.14 square millimeters to 1.00 square millimeters, the total length of wire on the spool can be 13,500 to 15,500 meters and the number of individual wires on the spools can be 1 to 6 wherein the minimum length of each wire is 150 meters. Spools or containers containing a larger number of individual wires or shorter lengths of wire often result in lower productivity and higher yield losses in the manufacture of the articles from the electrical wire.

Automotive electrical wire located under the hood in the engine compartment has traditionally been insulated with a single layer of high temperature insulation that is disposed over an uncoated copper-wire conductor. Thermoplastic polyesters, cross linked polyethylene and halogenated resins such as fluoropolymers and polyvinyl chloride have long filled the needs in this challenging environment for heat resistance, chemical resistance, flame retardance and flexibility in the high temperature insulation.

Thermoplastic polyester insulation layers have outstanding resistance to gas and oil, are mechanically tough and resistant to copper catalyzed degradation but can fail prematurely due to hydrolysis. The insulation layer(s) in thermoplastic polyester insulated electrical wires have also been found to crack when exposed to hot salty water and have failed when subjected to humidity temperature cycling.

There is an increasing desire to reduce or eliminate the use of halogenated resins in insulating layers due to their negative impact on the environment. In fact, many countries are beginning to mandate a decrease in the use of halogenated materials. However, as much of the wire coating extrusion equipment was created based upon the specifications of halogenated resins such as polyvinyl chloride, any replacement materials must be capable of being handled in a manner similar to polyvinyl chloride.

Cross linked polyethylene has largely been successful in providing high temperature insulation but this success may be difficult to sustain as the requirements for automotive electrical wire evolve. The amount of wiring in automobiles has increased as more electronics are being used in modern vehicles. The dramatic increase in wiring has motivated automobile manufacturers to reduce overall wire diameter by specifying reduced insulation layer thicknesses and specifying smaller conductor sizes. For example, ISO 6722 specifies, for a conductor having a cross sectional area of 2.5 square millimeters, that the thin wall insulation thickness be 0.35 millimeters and the ultra thin wall insulation thickness be 0.25 millimeters.

The reductions in insulation wall thicknesses pose difficulties when using crosslinked polyethylene. For crosslinked polyethylene the thinner insulation layer thicknesses result in shorter thermal life, when aged at oven temperatures between 150° C. and 180° C. This limits their thermal rating. For example, an electrical wire having a copper conductor with an adjacent crosslinked polyethylene insulation layer having a 0.75 millimeter wall thickness is flexible and the insulation layer does not crack when bent around a mandrel after being exposed to 150° C. for 3,000 hours. But in a similar electrical wire having a crosslinked polyethylene insulation layer having a 0.25 millimeter wall thickness the insulation layer becomes brittle after being exposed to 150° C. for 3,000 hours. The deleterious effects created by these extremely thin wall requirements have been attributed to copper catalyzed degradation, which is widely recognized as a problem in the industry.

Accordingly, there exists a need for covering materials suitable for use in conjunction with conductors, particularly in an electrical wire suitable for use in an automotive environment and is free of halogenated resins.

BRIEF DESCRIPTION OF THE INVENTION

The above described need is met by a covering comprising a thermoplastic composition wherein the thermoplastic composition comprises:

(i) a poly(arylene ether);

(ii) a polyolefin; and (iii) a polymeric compatibilizer, and further wherein an electrical wire comprising the covering disposed over a conductor has less than or equal to 5 spark leaks for 2,500 to 15,500 meters of wire.

The thermoplastic composition may further comprise a flame retardant.

In another embodiment, a covering comprising a thermoplastic composition wherein the thermoplastic composition comprises:

(i) a poly(arylene ether);

(ii) a polyolefin; and (iii) a polymeric compatibilizer, wherein the thermoplastic composition is substantially free of visible particulate impurities. The thermoplastic composition may further comprise a flame retardant.

In another embodiment a covering comprises a thermoplastic composition produced by a method comprising:

melt mixing a poly(arylene ether), a polyolefin, and a polymeric compatibilizer to form a mixture;

melt filtering the mixture through a filter.

DETAILED DESCRIPTION

Figure 1:
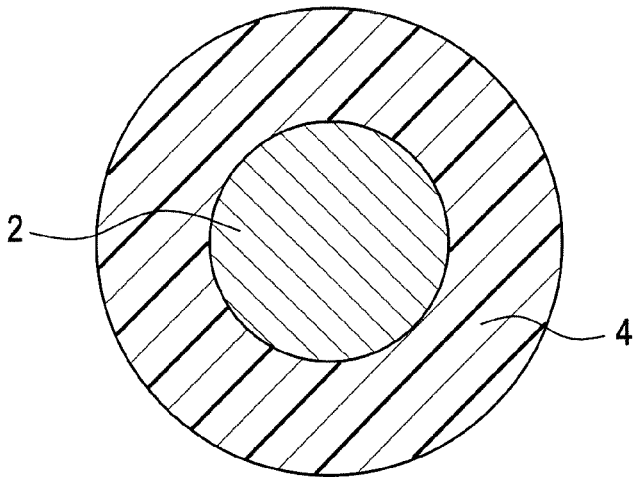
FIG. 1 is a schematic representation of a cross-section of covered conductor.

In this specification and in the claims, which follow, reference will be made to a number of terms which shall be defined to have the following meanings.

The singular forms "a," "an," and "the" include plural referents unless the context clearly dictates otherwise.

"Optional" or "optionally" means that the subsequently described event or circumstance may or may not occur, and that the description includes instances where the event occurs and instances where it does not.

The endpoints of all ranges reciting the same characteristic are independently combinable and inclusive of the recited endpoint. Values expressed as "greater than" or "less than" are inclusive the stated endpoint, e.g., "greater than 3.5" encompasses the value of 3.5.

ISO 6722, as referred to herein, is the Dec. 15, 2002 version of this standard.

Poly(arylene ether)/polyolefin blends are an unlikely choice for the polymeric coverings in covered conductors, particularly electrical wires for several reasons. These types of compositions have frequently been used in applications requiring rigidity but are generally considered unsuitable for applications requiring flexibility such as an electrical wire. Additionally, poly(arylene ether)/polyolefin blends, as described herein, have poly(arylene ether) dispersed in a polyolefin matrix. Given the known issues of copper catalyzed degradation in polyolefins it would seem unlikely that a composition having a polyolefin matrix could be successfully employed in an environment where copper catalyzed degradation is an issue. Furthermore, poly(arylene ether) has a propensity to form particulates and gels when exposed to temperatures above its glass transition temperature (Tg), increasing the likelihood of imperfections in the polymeric covering resulting in spark leaks.

A method for making a covering for covered conductor such as an electrical wire comprises melt mixing (compounding) the components for the thermoplastic composition used to form the covering, typically in a melt mixing device such as an compounding extruder or Banbury mixer. In one embodiment, the poly(arylene ether), polymeric compatibilizer, and polyolefin are simultaneously melt mixed. In another embodiment, the poly(arylene ether), polymeric compatibilizer, and optionally a portion of the polyolefin are melt mixed to form a first melt mixture. Subsequently, the polyolefin or remainder of the polyolefin is further melt mixed with the first melt mixture to form a second melt mixture. Alternatively, the poly(arylene ether) and a portion of the polymeric compatibilizer may be melt mixed to form a first melt mixture and then the polyolefin and the remainder of the polymeric compatibilizer are further melt mixed with the first melt mixture to form a second melt mixture.

The aforementioned melt mixing processes can be achieved without isolating the first melt mixture or can be achieved by isolating the first melt mixture. One or more melt mixing devices including one or more types of melt mixing devices can be used in these processes. In one embodiment, some components of the thermoplastic composition that forms the covering may be introduced and melt mixed in an extruder used to coat the conductor.

When the polymeric compatibilizer comprises two block copolymers, one having an aryl alkylene content greater than or equal to 50 weight percent and a second one having an aryl alkylene content less than 50 weight percent, the poly(arylene ether) and the block copolymer having an aryl alkylene content greater than or equal to 50 weight percent can be melt mixed to form a first melt mixture and the polyolefin and a block copolymer having an aryl alkylene content less than or equal to 50 weight percent can be melt mixed with the first melt mixture to form a second melt mixture.

The method and location of the addition of the optional flame retardant is typically dictated by the identity and physical properties, e.g., solid or liquid, of the flame retardant as well understood in the general art of polymer alloys and their manufacture. In one embodiment, the flame retardant is combined with one of the components of the thermoplastic composition, e.g., a portion of the polyolefin, to form a concentrate that is subsequently melt mixed with the remaining components.

The poly(arylene ether), polymeric compatibilizer, polyolefin and optional flame retardant are melt mixed at a temperature greater than or equal to the glass transition temperature of the poly(arylene ether) but less than the degradation temperature of the polyolefin. For example, the poly(arylene ether), polymeric compatibilizer, polyolefin and optional flame retardant may be melt mixed at an extruder temperature of 240° C. to 320° C., although brief periods in excess of this range may occur during melt mixing. Within this range, the temperature may be greater than or equal to 250° C., or, more specifically, greater than or equal to 260° C. Also within this range the temperature may be less than or equal to 310° C., or, more specifically, less than or equal to 300° C.

After some or all the components are melt mixed, the molten mixture can be melt filtered through one of more filters having openings with diameters of 20 micrometers to 150 micrometers. Within this range, the openings may have diameters less than or equal to 130 micrometers, or, more specifically, less than or equal to 110 micrometers. Also within this range the openings can have diameters greater than or equal to 30 micrometers, or, more specifically, greater than or equal to 40 micrometers.

Any suitable melt filtration system or device that can remove particulate impurities from the molten mixture may be used. In one embodiment the melt is filtered through a single melt filtration system. Multiple melt filtration systems are also contemplated.

Suitable melt filtration systems include filters made from a variety of materials such as, but not limited to, sintered-metal, metal mesh or screen, fiber metal felt, ceramic, or a combination of the foregoing materials, and the like. Particularly useful filters are sintered metal filters exhibiting high tortuosity, including the sintered wire mesh filters prepared by Pall Corporation and Martin Kurz & Company, Inc.

Any geometry of melt filter may be used including, but not limited to, cone, pleated, candle, stack, flat, wraparound, screens, cartridge, pack disc, as well as a combination of the foregoing, and the like. The selection of the geometry can vary depending on various parameters such as, for example, the size of the extruder and the throughput rate desired as well as the degree of particle filtration that is desired. Exemplary materials of construction include stainless steels, titanium, nickel, as well as other metals alloys. Various weaves of wire fabric including plain, dutch, square, twill and combinations of weaves can be used. Especially useful are filters that have been designed to minimize internal volume and low flow areas and to withstand repeated cleaning cycles.

The melt filtration system may include a periodic or continuous screen changing filter or batch filters. For example, continuous screen changing filters may include a ribbon of screen filter that is slowly passed into the path of a melt flow in an extruder. The melt mixture passes through the filter and the filter collects particulate impurities within the melt and these impurities are carried out of the extruder with the filter ribbon as it is periodically or continuously renewed with a new section of ribbon.

In one embodiment, the filter openings have a maximum diameter that is less than or equal to half of the thickness of the covering that will be applied to the conductor. For example, if the covered conductor has a covering with a thickness of 200 micrometers, the filter openings have a maximum diameter less than or equal to 100 micrometers.

The minimum size of the filter openings is dependent upon a number of variables. Smaller filter openings may result in greater pressure on the upstream side of the filter. Accordingly, the filter openings and method of operation must be chosen to prevent unsafe pressure on the upstream side. In addition the use of a filter having filter openings less than 20 micrometers can result in poor flow both upstream and downstream of the filter. Poor flow can extend the residence time for some portions of the melt mixture. Longer residence times can result in the creation or enlargement of particulates in the composition, which, when applied to the conductor, can cause spark leaks.

In one embodiment the melt filtered mixture is passed through a die head and pelletized by either strand pelletization or underwater pelletization. The pelletized material may be packaged, stored and transported. In one embodiment the pellets are packaged into metal foil lined plastic bags, typically polypropylene bags, or metal foil lined paper bags. Substantially all of the air can be evacuated from the pellet filled bags.

In one embodiment, the thermoplastic composition is substantially free of visible particulate impurities. Visible particulates or "black specks" are dark or colored particulates generally visible to the human eye without magnification and having an average diameter of 40 micrometers or greater. Although some people are able to without magnification visually detect particles having an average diameter smaller than 30 micrometers and other people can detect only particles having an average diameter larger than 40 micrometers, the terms "visible particles," "visible particulates," and "black specks" when used herein without reference to a specified average diameter means those particulates having an average diameter of 40 micrometers or greater. As used herein, the term "substantially free of visible particulate impurities" when applied to the thermoplastic composition means that when the composition is injection molded to form 5 plaques having dimensions of 75 millimeters×50 millimeters and having a thickness of 3 millimeters and the plaques are visually inspected on all sides for black specks with the naked eye the total number of black specks for all five plaques is less than or equal to 100, or, more specifically, less than or equal to 70, or, even more specifically, less than or equal to 50.

In one embodiment the pellets are melted and the composition applied to the conductor by a suitable method such as extrusion coating to form an electrical wire. For example, a coating extruder equipped with a screw, crosshead, breaker plate, distributor, nipple, and die can be used. The melted thermoplastic composition forms a covering disposed over a circumference of the conductor. Extrusion coating may employ a single taper die, a double taper die, other appropriate die or combination of dies to position the conductor centrally and avoid die lip build up.

In one embodiment, the composition is applied to the conductor to form a covering disposed over the conductor. Additional layers may be applied to the covering.

In one embodiment the composition is applied to a conductor having one or more intervening layers between the conductor and the covering to form a covering disposed over the conductor. For instance, an optional adhesion promoting layer may be disposed between the conductor and covering. In another example the conductor may be coated with a metal deactivator prior to applying the covering. In another example the intervening layer comprises a thermoplastic or thermoset composition that, in some cases, is foamed.

The conductor may comprise a single strand or a plurality of strands. In some cases, a plurality of strands may be bundled, twisted, or braided to form a conductor. Additionally, the conductor may have various shapes such as round or oblong. The conductor may be any type of conductor used to transmit a signal. Exemplary signals include optical, electrical, and electromagnetic. Glass fibers are one example of an optical conductor. Suitable electrical conductors include, but are not limited to, copper, aluminum, lead, and alloys comprising one or more of the foregoing metals. The conductor may also be an electrically conductive ink or paste.

The cross-sectional area of the conductor and thickness of the covering may vary and is typically determined by the end use of the covered conductor. In one embodiment the covered conductor is an electrical wire and the electrical wire can be used as electric wire without limitation, including, for example, for harness wire for automobiles, wire for household electrical appliances, wire for electric power, wire for instruments, wire for information communication, wire for electric cars, as well as ships, airplanes, and the like. In one embodiment the covered conductor is an optical cable and can be used in interior applications (inside a building), exterior applications (outside a building) or both interior and exterior applications. Exemplary applications include data transmission networks and voice transmission networks such as telephone networks and local area networks (LAN).

In some embodiments it may be useful to dry the thermoplastic composition before extrusion coating. Exemplary drying conditions are 60–90° C. for 2–20 hours. Additionally, in one embodiment, during extrusion coating, the thermoplastic composition is melt filtered, prior to formation of the covering, through one or more filters having opening diameters of 20 micrometers to 150 micrometers. Within this range, the openings diameters may be greater than or equal to 30 micrometers, or more specifically greater than or equal to 40 micrometers. Also within this range the openings diameters may be less than or equal to 130 micrometers, or, more specifically, less than or equal to 110 micrometers. The coating extruder may comprise one or more filters as described above.

In one embodiment, during extrusion coating, the thermoplastic composition is melt filtered, prior to formation of the covering, through one or more filters having opening diameters wherein the filter openings have a maximum diameter that is less than or equal to half of the thickness of the covering that will be applied to the conductor.

In another embodiment the melt filtered mixture produced by melt mixing is not pelletized. Rather the molten melt filtered mixture is formed directly into a covering for the conductor using a coating extruder that is in tandem with the melt mixing apparatus, typically a compounding extruder. The coating extruder may comprise one or more filters as described above.

It is contemplated that in some embodiments the thermoplastic composition may be extruded or otherwise formed into a tube that will provide a covering. The conductor and optional intervening layer may be inserted into the tube to form the covered conductor.

A color concentrate or masterbatch may be added to the composition prior to or during the extrusion coating. When a color concentrate is used it is typically present in an amount less than or equal to 3 weight percent, based on the total weight of the composition. In one embodiment dye and/or pigment employed in the color concentrate is free of chlorine, bromine, and fluorine. As appreciated by one of skill in the art, the color of the composition prior to the addition of color concentrate may impact the final color achieved and in some cases it may be advantageous to employ a bleaching agent and/or color stabilization agents. Bleaching agents and color stabilization agents are known in the art and are commercially available.

The extruder temperature during extrusion coating is generally less than or equal to 320° C., or, more specifically, less than or equal to 310° C., or, more specifically, less than or equal to 290° C. Additionally the processing temperature is adjusted to provide a sufficiently fluid molten composition to afford a covering for the conductor, for example, higher than the melting point of the thermoplastic composition, or more specifically at least 10° C. higher than the melting point of the thermoplastic composition.

After extrusion coating the covered conductor is usually cooled using a water bath, water spray, air jets, or a combination comprising one or more of the foregoing cooling methods. Exemplary water bath temperatures are 20 to 85° C. The water may be de-ionized and may also be filtered to remove impurities. As mentioned above, when the covered conductor is an electrical wire, the electrical wire is checked for spark leaks using an in-line method. An exemplary method of testing for spark leaks comprises using the conductor of the electrical wire as a grounded electrode and passing the electrical wire next to or through a charged electrode such that the electrical wire is in contact with the charged electrode. When the polymeric covering on the electrical wire comprises a defect such as a pin hole or crack an arc between the charged electrode and the conductor of the electrical wire is generated and detected. Exemplary charged electrodes include bead chains and brushes. The electrode may be charged using alternating current or direct current as indicated by the end use of the wire and any relevant industrial specifications for the wire. The voltage may be determined by one of ordinary skill in the art of spark leak testing. The frequency used depends upon the load capacitance and may also be determined by one of ordinary skill in the art of spark leak testing. Spark testing equipment is commercially available from, for example, The Clinton Instrument Company, Beta LaserMike, and Zumbach.

When a spark leak is detected the electrical wire is cut to remove the portion with the spark leak. Each spark leak therefore generates a new length of wire. After being checked for spark leaks the electrical wire may be wound onto a spool or like device. Exemplary winding speeds are 50 meters per minute (m/min) to 1500 m/min. The electrical wire may be placed into a container with or without the spool or like device. Several lengths of wire may be combined to make up the total length of wire in a container or on a spool or like device. The total length of the wire put into the container or onto a spool or like device is usually dependent upon the cross sectional area of the conductor and the thickness of the covering.

The length of electrical wire between the spark leaks is important. If a container of electrical wire contains sections (lengths) of electrical wire having a length less than 150 meters, the electrical wire can be inefficient to use because the electrical wire is used in a continuous fashion to build various articles, e.g., wire harnesses and the like. Work flow must be interrupted to start a new section of electrical wire. Additionally, if there are more than 6 individual sections of electrical wire per container then use of the electrical wire is also inefficient. Thus both the quantity and frequency of sparks leaks is important.

Thus it's clear that a thermoplastic composition must be capable of being applied to the conductor in a robust manner with a minimum or absence of spark leaks such that the minimum length of electrical wire having no spark leaks is 150 meters, or more specifically 250 meters, or, even more specifically 500 meters when the wire is tested using the spark leak testing method appropriate to the type of electrical wire. Spark leaks can be caused by imperfections in the covering such as gaps, e.g., pinholes, in the wire covering, particulate matter and the like.

The imperfections can be introduced by the covering process or can originate in the thermoplastic composition. Imperfections may be introduced by the covering process through inadequate cleaning of the coating extruder or if operation of the coating extruder becomes stalled for an extended period of time such that the thermoplastic composition forms gels and black specks. Residual material from a prior covering may form particulates that result in imperfections and spark leaks. Imperfections introduced to the thermoplastic composition may be decreased or eliminated by thorough cleaning of the coating extruder particularly the sections after the filter and melt filtering the thermoplastic composition.

Similarly, cleaning the melt mixing equipment, particularly the sections after the filter can decrease or eliminate particulate materials and gels resulting from residual material from prior use of the compounding extruder.

Figure 2:
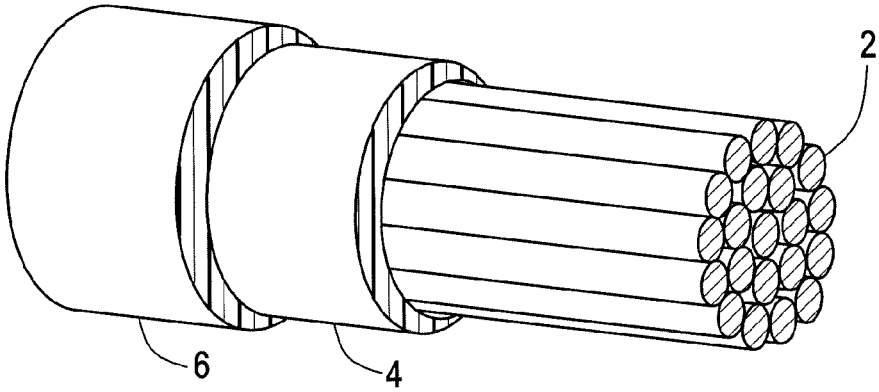
FIGS. 2 and 3 are perspective views of covered conductor having multiple layers.
Figure 3:
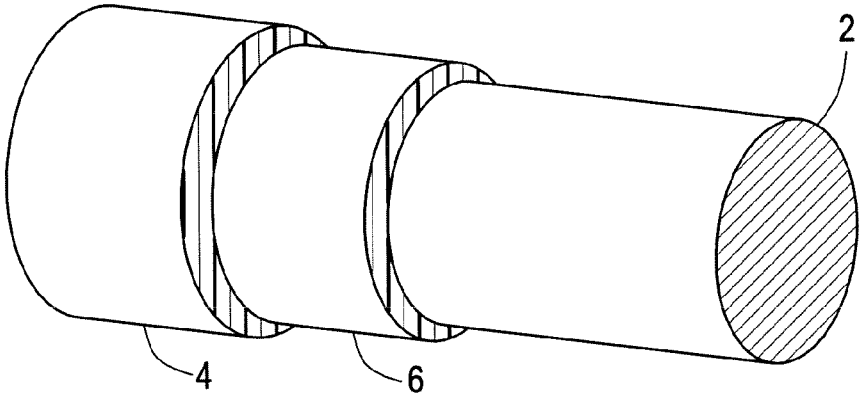

A cross-section of an exemplary covered conductor is seen in FIG. 1. FIG. 1 shows a covering, 4, disposed over a conductor, 2. In one embodiment, the covering, 4, comprises a foamed thermoplastic composition. Perspective views of exemplary covered conductors are shown in FIGS. 2 and 3. FIG. 2 shows a covering, 4, disposed over a conductor, 2, comprising a plurality of strands and an optional additional layer, 6, disposed over the covering, 4, and the conductor, 2. In one embodiment, the covering, 4, comprises a foamed thermoplastic composition. Conductor, 2, can also comprise a unitary conductor. FIG. 3 shows a covering, 4, disposed over a unitary conductor, 2, and an intervening layer, 6. In one embodiment, the intervening layer, 6, comprises a foamed composition. Conductor, 2, can also comprise a plurality of strands.

In one embodiment a covering with a 0.15 millimeter (mm) to 0.25 mm thickness is disposed over a conductor with a cross sectional area of 0.15 square millimeters ($mm^2$) to 1.10 $mm^2$ to form a covered conductor. For a total length of 13,500 to 15,500 meters of covered conductor there are less than or equal to 6 individual lengths, or, more specifically, less than or equal to 4 individual lengths, or, even more specifically, less than or equal to 3 individual lengths and each individual length is greater than or equal to 150 meters, or more specifically, greater than or equal to 250 meters, or, even more specifically, greater than or equal to 500 meters. As used herein, an individual length refers to a single length of covered conductor having two ends.

In another embodiment, a covering with a 0.19 to 0.31 mm thickness is disposed over a conductor with a cross sectional area of 0.30 to 1.30 $mm^2$ to form a covered conductor. For a total length of 8,500 to 14,000 meters of covered conductor there are less than or equal to 6 individual lengths, or, more specifically, less than or equal to 4 individual lengths, or, even more specifically, less than or equal to 3 individual lengths and each individual length is greater than or equal to 150 meters, or more specifically, greater than or equal to 250 meters, or, even more specifically, greater than or equal to 500 meters.

In another embodiment, a covering with a 0.29 to 0.36 mm thickness is disposed over a conductor with a cross sectional area of 1.20 to 2.10 $mm^2$ to form a covered conductor. For a total length of 5,000 to 7,100 meters of covered conductor there are less than or equal to 6 individual lengths, or, more specifically, less than or equal to 4 individual lengths, or, even more specifically, less than or equal to 3 individual lengths and each individual length is greater than or equal to 150 meters, or more specifically, greater than or equal to 250 meters, or, even more specifically, greater than or equal to 500 meters.

In another embodiment, a covering with a 0.3 to 0.8 mm thickness is disposed over a conductor with a cross sectional area of 2.90 to 4.50 $mm^2$ to form a covered conductor. For a total length of 2,500 to 5,000 meters of covered conductor there are less than or equal to 6 individual lengths, or, more specifically, less than or equal to 4 individual lengths, or, even more specifically, less than or equal to 3 individual lengths and each individual length is greater than or equal to 150 meters, or more specifically, greater than or equal to 250 meters, or, even more specifically, greater than or equal to 500 meters.

The thermoplastic composition described herein comprises at least two phases, a polyolefin phase and a poly (arylene ether) phase. The polyolefin phase is continuous. In some embodiments, the poly(arylene ether) phase is dispersed within the polyolefin phase. Good compatibilization between the phases can result in improved physical properties including higher impact strength at low temperatures and room temperature, better heat aging, better flame retardance, as well as greater tensile elongation. It is generally accepted that the morphology of the composition is indicative of the degree or quality of compatibilization. Small, relatively uniformly sized particles of poly(arylene ether) evenly distributed throughout an area of the composition are indicative of good compatibilization.

The thermoplastic compositions described herein are essentially free of an alkenyl aromatic resin such as polystyrene or rubber-modified polystyrene (also known as high impact polystyrene or HIPS). Essentially free is defined as containing less than 10 weight percent (wt %), or, more specifically less than 7 wt %, or, more specifically less than 5 wt %, or, even more specifically less than 3 wt % of an alkenyl aromatic resin, based on the combined weight of poly(arylene ether), polyolefin and block copolymer(s). In one embodiment, the composition is completely free of an alkenyl aromatic resin. Surprisingly the presence of the alkenyl aromatic resin can negatively affect the compatibilization between the poly(arylene ether) phase and the polyolefin phase.

In one embodiment, the composition has a flexural modulus of 8000 to less than 18000 kilograms/square centimeter ($kg/cm^2$) (800 to less than 1800 Megapascals (MPa)). Within this range the flexural modulus may be greater than or equal to 10,000 $kg/cm^2$ (1000 Mpa), or, more specifically, greater than or equal to 12,000 $kg/cm^2$ (1200 Mpa). Also within this range the flexural modulus may be less than or equal to 17,000 $kg/cm^2$ (1700 Mpa), or, more specifically, less than or equal to 16,000 $kg/cm^2$ (1600 Mpa). Flexural modulus, as described herein, is determined using ASTM D790-03 and a speed of 1.27 millimeters per minute. Flexural modulus values are the average of three samples. The samples for flexural modulus are formed using an injection pressure of 600–700 kilograms-force per square centimeter and a hold time of 15 to 20 seconds on a Plastar Ti-80$G_2$ from Toyo Machinery & Metal Co. LTD. The remaining molding conditions are shown in Table 1.

TABLE 1

| | |
|---|---|
| Drying temperature (° C.) | 80 |
| Dry time in hours | 4 |
| Cylinder temperature | |
| 1 | 240 |
| 2 | 250 |
| 3 | 260 |
| 4 | 260 |
| DH | 260 |
| Mold temperature | 80 |

In one embodiment the covered conductor is an electrical wire that meets or exceeds the requirements of ISO 6722, specifically the requirements for abrasion, heat aging for classes A, B, C, chemical resistance, and environmental cycling.

As used herein, a "poly(arylene ether)" comprises a plurality of structural units of Formula (I):

(I)

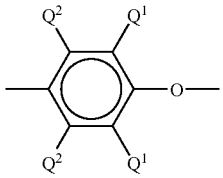

wherein for each structural unit, each $Q^1$ and $Q^2$ is independently hydrogen, halogen, primary or secondary lower alkyl (e.g., an alkyl containing 1 to 7 carbon atoms), phenyl, haloalkyl, aminoalkyl, alkenylalkyl, alkynylalkyl, hydrocarbonoxy, aryl and halohydrocarbonoxy wherein at least two carbon atoms separate the halogen and oxygen atoms. In some embodiments, each $Q^1$ is independently alkyl or phenyl, for example, $C_{1-4}$ alkyl, and each $Q^2$ is independently hydrogen or methyl. The poly(arylene ether) may comprise molecules having aminoalkyl-containing end group(s), typically located in an ortho position to the hydroxy group. Also frequently present are tetramethyl diphenylquinone (TMDQ) end groups, typically obtained from reaction mixtures in which tetramethyl diphenylquinone by-product is present.

The poly(arylene ether) may be in the form of a homopolymer; a copolymer; a graft copolymer; an ionomer; or a block copolymer; as well as combinations comprising at least one of the foregoing. Poly(arylene ether) includes polyphenylene ether comprising 2,6-dimethyl-1,4-phenylene ether units optionally in combination with 2,3,6-trimethyl-1,4-phenylene ether units.

The poly(arylene ether) may be prepared by the oxidative coupling of monohydroxyaromatic compound(s) such as 2,6-xylenol, 2,3,6-trimethylphenol and combinations of 2,6-xylenol and 2,3,6-trimethyphenol. Catalyst systems are generally employed for such coupling; they can contain heavy metal compound(s) such as a copper, manganese or cobalt compound, usually in combination with various other materials such as a secondary amine, tertiary amine, halide or combination of two or more of the foregoing.

In one embodiment, the poly(arylene ether) comprises a capped poly(arylene ether). The terminal hydroxy groups may be capped with a capping agent via an acylation reaction, for example. The capping agent chosen is desirably one that results in a less reactive poly(arylene ether) thereby reducing or preventing crosslinking of the polymer chains and the formation of gels or black specks during processing at elevated temperatures. Suitable capping agents include, for example, esters of salicylic acid, anthranilic acid, or a substituted derivative thereof, and the like; esters of salicylic acid, and especially salicylic carbonate and linear polysalicylates, are preferred. As used herein, the term "ester of salicylic acid" includes compounds in which the carboxy group, the hydroxy group, or both have been esterified. Suitable salicylates include, for example, aryl salicylates such as phenyl salicylate, acetylsalicylic acid, salicylic carbonate, and polysalicylates, including both linear polysalicylates and cyclic compounds such as disalicylide and trisalicylide. In one embodiment the capping agents are selected from salicylic carbonate and the polysalicylates, especially linear polysalicylates, and combinations comprising one of the foregoing. Exemplary capped poly(arylene ether) and their preparation are described in U.S. Pat. No. 4,760,118 to White et al. and U.S. Pat. No. 6,306,978 to Braat et al.

Capping poly(arylene ether) with polysalicylate is also believed to reduce the amount of aminoalkyl terminated groups present in the poly(arylene ether) chain. The aminoalkyl groups are the result of oxidative coupling reactions that employ amines in the process to produce the poly (arylene ether). The aminoalkyl group, ortho to the terminal hydroxy group of the poly(arylene ether), can be susceptible to decomposition at high temperatures. The decomposition is believed to result in the regeneration of primary or secondary amine and the production of a quinone methide end group, which may in turn generate a 2,6-dialkyl-1-hydroxyphenyl end group. Capping of poly(arylene ether) containing aminoalkyl groups with polysalicylate is believed to remove such amino groups to result in a capped terminal hydroxy group of the polymer chain and the formation of 2-hydroxy-N,N-alkylbenzamine (salicylamide). The removal of the amino group and the capping provides a poly(arylene ether) that is more stable to high temperatures, thereby resulting in fewer degradative products during processing of the poly(arylene ether).

The poly(arylene ether) can have a number average molecular weight of 3,000 to 40,000 grams per mole (g/mol) and a weight average molecular weight of 5,000 to 80,000 g/mol, as determined by gel permeation chromatography using monodisperse polystyrene standards, a styrene divinyl benzene gel at 40° C. and samples having a concentration of 1 milligram per milliliter of chloroform. The poly(arylene ether) or combination of poly(arylene ether)s has an initial intrinsic viscosity greater than or equal to 0.25 dl/g, as measured in chloroform at 25° C. Initial intrinsic viscosity is defined as the intrinsic viscosity of the poly(arylene ether) prior to melt mixing with the other components of the composition and final intrinsic viscosity is defined as the intrinsic viscosity of the poly(arylene ether) after melt mixing with the other components of the composition. As understood by one of ordinary skill in the art the viscosity of the poly(arylene ether) may be up to 30% higher after melt mixing. The percentage of increase can be calculated by (final intrinsic viscosity—initial intrinsic viscosity)/initial intrinsic viscosity. Determining an exact ratio, when two initial intrinsic viscosities are used, will depend somewhat on the exact intrinsic viscosities of the poly(arylene ether) used and the ultimate physical properties that are desired.

The poly(arylene ether) used to make the thermoplastic composition can be substantially free of visible particulate impurities. In one embodiment, the poly(arylene ether) is substantially free of particulate impurities greater than 15 micrometers in diameter. As used herein, the term "substantially free of visible particulate impurities" when applied to poly(arylene ether) means that a ten gram sample of a poly(arylene ether) dissolved in fifty milliliters of chloroform ($CHCl_3$) exhibits fewer than 5 visible specks when viewed in a light box. Particles visible to the naked eye are typically those greater than 40 micrometers in diameter. As used herein, the term "substantially free of particulate impurities greater than 15 micrometers" means that of a forty gram sample of poly(arylene ether) dissolved in 400 milliliters of $CHCl_3$, the number of particulates per gram having a size of 15 micrometers is less than 50, as measured by a Pacific Instruments ABS2 analyzer based on the average of five samples of twenty milliliter quantities of the dissolved polymeric material that is allowed to flow through the analyzer at a flow rate of one milliliter per minute (plus or minus five percent).

The thermoplastic composition comprises the poly (arylene ether) in an amount of 30 to 65 weight percent (wt %), with respect to the total weight of the composition. Within this range the amount of poly(arylene ether) may be greater than or equal to 40 wt %, or, more specifically, greater than or equal to 45 wt %. Also within this range the amount of poly(arylene ether) may be less than or equal to 55 wt %.

Polyolefins are of the general structure: $C_nH_{2n}$ and include polyethylene, polypropylene and polyisobutylene. Exemplary homopolymers include polyethylene, LLDPE (linear low density polyethylene), HDPE (high density polyethylene) and MDPE (medium density polyethylene) and isotatic polypropylene. Polyolefin resins of this general structure and methods for their preparation are well known in the art and are described for example in U.S. Pat. Nos. 2,933,480, 3,093,621, 3,211,709, 3,646,168, 3,790,519, 3,884,993, 3,894,999, 4,059,654, 4,166,055 and 4,584,334.

Copolymers of polyolefins may also be used such as copolymers of ethylene and alpha olefins like octene, propylene and 4-methylpentene-1 as well as copolymers of ethylene and one or more rubbers and copolymers of propylene and one or more rubbers. Copolymers of ethylene and $C_3$–$C_{10}$ monoolefins and non-conjugated dienes, herein referred to as EPDM copolymers, are also suitable. Examples of suitable $C_3$–$C_{10}$ monoolefins for EPDM copolymers include propylene, 1-butene, 2-butene, 1-pentene, 2-pentene, 1-hexene, 2-hexene and 3-hexene. Suitable dienes include 1,4 hexadiene and monocylic and polycyclic dienes. Mole ratios of ethylene to other $C_3$–$C_{10}$ monoolefin monomers can range from 95:5 to 5:95 with diene units being present in the amount of from 0.1 to 10 mol %. EPDM copolymers can be functionalized with an acyl group or electrophilic group for grafting onto the polyphenylene ether as disclosed in U.S. Pat. No. 5,258,455.

The thermoplastic composition may comprise a single homopolymer, a combination of homopolymers, a single copolymer, a combination of copolymers or a combination comprising a homopolymer and a copolymer.

In one embodiment the polyolefin is selected from the group consisting of polypropylene, high density polyethylene and combinations of polypropylene and high density polyethylene. The polypropylene can be homopolypropylene or a polypropylene copolymer. Copolymers of polypropylene and rubber or block copolymers are sometimes referred to as impact modified polypropylene. Such copolymers are typically heterophasic and have sufficiently long sections of each component to have both amorphous and crystalline phases. Additionally the polypropylene may comprise a combination of homopolymer and copolymer, a combination of homopolymers having different melting temperatures, or a combination of homopolymers having different melt flow rates.

In one embodiment the polypropylene comprises a crystalline polypropylene such as isotactic polypropylene. Crystalline polypropylenes are defined as polypropylenes having a crystallinity content greater than or equal to 20%, or, more specifically, greater than or equal to 25%, or, even more specifically, greater than or equal to 30%. Crystallinity may be determined by differential scanning calorimetry (DSC).

In some embodiments the polypropylene has a melting temperature greater than or equal to 134° C., or, more specifically, greater than or equal to 140° C., or, even more specifically, greater than or equal to 145° C.

The polypropylene has a melt flow rate (MFR) greater than 0.4 grams per 10 minutes and less than or equal to 15 grams per ten minutes (g/10 min). Within this range the melt flow rate may be greater than or equal to 0.6 g/10 min. Also within this range the melt flow rate may be less than or equal to 10, or, more specifically, less than or equal to 6, or, more specifically, less than or equal to 5 g/10 min. Melt flow rate can be determined according to ASTM D1238 using either powdered or pelletized polypropylene, a load of 2.16 kilograms and a temperature of 230° C.

The high density polyethylene can be homo polyethylene or a polyethylene copolymer. Additionally the high density polyethylene may comprise a combination of homopolymer and copolymer, a combination of homopolymers having different melting temperatures, or a combination of homopolymers having a different melt flow rate and generally having a density of 0.941 to 0.965 g/cm$^3$.

In some embodiments the high density polyethylene has a melting temperature greater than or equal to 124° C., or, more specifically, greater than or equal to 126° C., or, even more specifically, greater than or equal to 128° C.

The high density polyethylene has a melt flow rate (MFR) greater than or equal to 0.10 grams per 10 minutes and less than or equal to 15 grams per ten minutes (g/10 min). Within this range the melt flow rate may be greater than or equal to 1.0 g/10 min. Also within this range the melt flow rate may be less than or equal to 10, or, more specifically, less than or equal to 6, or, more specifically, less than or equal to 5 g/10 min. Melt flow rate can be determined according to ASTM D1238 using either powdered or pelletized polyethylene, a load of 2.16 kilograms and a temperature of 190° C.

The composition may comprise polyolefin in an amount of 15 to 35 weight percent (wt %), with respect to the total weight of the composition. Within this range the amount of polyolefin may be greater than or equal to 17 wt %, or, more specifically, greater than or equal to 20 wt %. Also within this range the amount of polyolefin may be less than or equal to 33 wt %, or, more specifically, less than or equal to 30 wt %.

In one embodiment the polyolefin comprises high density polyethylene (HDPE) and polypropylene and the amount of HDPE by weight is less than the amount of polypropylene by weight.

In one embodiment the polyolefin is present in an amount by weight that is less than the amount of poly(arylene ether) by weight.

Polymeric compatibilizers are resins and additives that improve the compatibility between the polyolefin phase and the poly(arylene ether) phase. Polymeric compatibilizers include block copolymers, polypropylene-polystyrene graft copolymers and combinations of block copolymers and polypropylene-polystyrene graft copolymers as described below.

As used herein and throughout the specification "block copolymer" refers to a single block copolymer or a combination of block copolymers. The block copolymer comprises at least one block (A) comprising repeating aryl alkylene units and at least one block (B) comprising repeating alkylene units. The arrangement of blocks (A) and (B) may be a linear structure or a so-called radial teleblock structure having branched chains. A-B-A triblock copolymers have two blocks A comprising repeating aryl alkylene units. The pendant aryl moiety of the aryl alkylene units may be monocyclic or polycyclic and may have a substituent at any available position on the cyclic portion. Suitable substituents include alkyl groups having 1 to 4 carbons. An exemplary aryl alkylene unit is phenylethylene, which is shown in Formula II:

(II)

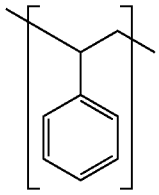

Block A may further comprise alkylene units having 2 to 15 carbons as long as the quantity of aryl alkylene units exceeds the quantity of alkylene units.

Block B comprises repeating alkylene units having 2 to 15 carbons such as ethylene, propylene, butylene or combinations of two or more of the foregoing. Block B may further comprise aryl alkylene units as long as the quantity of alkylene units exceeds the quantity of aryl alkylene units.

Each occurrence of block A may have a molecular weight which is the same or different than other occurrences of block A. Similarly each occurrence of block B may have a molecular weight which is the same or different than other occurrences of block B. The block copolymer may be functionalized by reaction with an alpha-beta unsaturated carboxylic acid.

In one embodiment, the B block comprises a copolymer of aryl alkylene units and alkylene units having 2 to 15 carbons such as ethylene, propylene, butylene or combinations of two or more of the foregoing. The B block may further comprise some unsaturated non-aromatic carbon-carbon bonds.

The B block may be a controlled distribution copolymer. As used herein "controlled distribution" is defined as referring to a molecular structure lacking well-defined blocks of either monomer, with "runs" of any given single monomer attaining a maximum number average of 20 units as shown by either the presence of only a single glass transition temperature (Tg), intermediate between the Tg of either homopolymer, or as shown via proton nuclear magnetic resonance methods. When the B block comprises a controlled distribution copolymer, each A block may have an average molecular weight of 3,000 to 60,000 g/mol and each B block may have an average molecular weight of 30,000 to 300,000 g/mol, as determined using light scattering techniques. When the B block is a controlled distribution polymer, each B block comprises at least one terminal region adjacent to an A block that is rich in alkylene units and a region not adjacent to the A block that is rich in aryl alkylene units. The total amount of aryl alkylene units is 15 to 75 weight percent, based on the total weight of the block copolymer. The weight ratio of alkylene units to aryl alkylene units in the B block may be 5:1 to 1:2. Exemplary block copolymers are further disclosed in U.S. Patent Application No. 2003/181584 and are commercially available from Kraton Polymers under the trademark KRATON. Exemplary grades are A-RP6936 and A-RP6935.

The repeating aryl alkylene units result from the polymerization of aryl alkylene monomers such as styrene. The repeating alkylene units result from the hydrogenation of repeating unsaturated units derived from a diene such as butadiene. The butadiene may comprise 1,4-butadiene and/or 1,2-butadiene. The B block may further comprise some unsaturated non-aromatic carbon-carbon bonds.

Exemplary block copolymers include polyphenylethylene-poly(ethylene/propylene)-polyphenylethylene (sometimes referred to as polystyrene-poly(ethylene/propylene)-polystyrene) and polyphenylethylene-poly(ethylene/butylene)-polyphenylethylene (sometimes referred to as polystyrene-poly(ethylene/butylene)-polystyrene).

In one embodiment, the polymeric compatibilizer comprises two block copolymers. The first block copolymer has an aryl alkylene content greater than to equal to 50 weight percent based on the total weight of the first block copolymer. The second block copolymer has an aryl alkylene content less than or equal to 50 weight percent based on the total weight of the second block copolymer. An exemplary combination of block copolymers is a first polyphenylethylene-poly(ethylene/butylene)-polyphenylethylene having a phenylethylene content of 15 weight percent to 40 weight percent, based on the total weight of the block copolymer and a second polyphenylethylene-poly(ethylene-butylene)-polyphenylethylene having a phenylethylene content of 55 weight percent to 70 weight percent, based on the total weight of the block copolymer may be used. Exemplary block copolymers having an aryl alkylene content greater than 50 weight percent are commercially available from Asahi under the trademark TUFTEC and have grade names such as H1043, as well as some grades available under the tradename SEPTON from Kuraray. Exemplary block copolymers having an aryl alkylene content less than 50 weight percent are commercially available from Kraton Polymers under the trademark KRATON and have grade names such as G-1701, G-1702, G-1730, G-1641, G-1650, G-1651, G-1652, G-1657, A-RP6936 and A-RP6935.

In one embodiment, the polymeric compatibilizer comprises a diblock block copolymer and a triblock block copolymer.

In some embodiments the block copolymer has a number average molecular weight of 5,000 to 1,000,000 grams per mole (g/mol), as determined by gel permeation chromatography (GPC) using polystyrene standards. Within this range, the number average molecular weight may be at least 10,000 g/mol, or, more specifically, at least 30,000 g/mol, or, even more specifically, at least 45,000 g/mol. Also within this range, the number average molecular weight may preferably be up to 800,000 g/mol, or, more specifically, up to 700,000 g/mol, or, even more specifically, up to 650,000 g/mol.

A polypropylene-polystyrene graft copolymer is herein defined as a graft copolymer having a propylene polymer backbone and one or more styrene polymer grafts.

The propylene polymer material that forms the backbone or substrate of the polypropylene-polystyrene graft copolymer is (a) a homopolymer of propylene; (b) a random copolymer of propylene and an olefin selected from the group consisting of ethylene and $C_4$–$C_{10}$ olefins, provided that, when the olefin is ethylene, the polymerized ethylene content is up to about 10 weight percent, preferably up to about 4 weight percent, and when the olefin is a $C_4$–$C_{10}$ olefin, the polymerized content of the $C_4$–$C_{10}$ olefin is up to about 20 weight percent, preferably up to about 16 weight percent; (c) a random terpolymer of propylene and at least two olefins selected from the group consisting of ethylene and $C_4$–$C_{10}$ alpha-olefins, provided that the polymerized $C_4$–$C_{10}$ alpha-olefin content is up to about 20 weight percent, preferably up to about 16 weight percent, and, when ethylene is one of the olefins, the polymerized ethylene content is up to about 5 weight percent, preferably up to about 4 weight percent; or (d) a homopolymer or random copolymer of propylene which is impact-modified with an ethylene-propylene monomer rubber in the reactor as well as by physical blending, the ethylene-propylene monomer rubber content of the modified polymer being about 5 to about 30 weight percent, and the ethylene content of the rubber being about 7 to about 70 weight percent, and preferably about 10 to about 40 weight percent. The $C_4$–$C_{10}$ olefins include the linear and branched $C_4$–$C_{10}$ alpha-olefins such as, for example, 1-butene, 1-pentene, 3-methyl-1-butene, 4-methyl-1-pentene, 1-hexene, 3,4-dimethyl-1-butene, 1-heptene, 1-octene, 3-methyl-hexene, and the like. Propylene homopolymers and impact-modified propylene homopolymers are preferred propylene polymer materials. Although not preferred, propylene homopolymers and random copolymers impact modified with an ethylene-propylene-diene monomer rubber having a diene content of about 2 to about 8 weight percent also can be used as the propylene polymer material. Suitable dienes include dicyclopentadiene, 1,6-hexadiene, ethylidene norbornene, and the like.

The term "styrene polymer", used in reference to the grafted polymer present on the backbone of propylene polymer material in the polypropylene-polystyrene graft copolymer, denotes (a) homopolymers of styrene or of an alkyl styrene having at least one $C_1$–$C_4$ linear or branched alkyl ring substituent, especially a p-alkyl styrene; (b) copolymers of the (a) monomers with one another in all proportions; and (c) copolymers of at least one (a) monomer with alpha-methyl derivatives thereof, e.g., alpha-methylstyrene, wherein the alpha-methyl derivative constitutes about 1 to about 40% of the weight of the copolymer.

The polypropylene-polystyrene graft copolymer can comprise about 10 to about 90 weight percent of the propylene polymer backbone and about 90 to about 10 weight percent of the styrene polymer graft. Within these ranges, the propylene polymer backbone may account for at least about 20 weight percent, of the total graft copolymer; and the propylene polymer backbone may account for up to about 40 weight percent of the total graft copolymer. Also within these ranges, the styrene polymer graft may account for at least about 50 weight percent, or, more specifically, at least about 60 weight percent, of the total graft copolymer.

The preparation of polypropylene-polystyrene graft copolymers is described, for example, in U.S. Pat. No. 4,990,558 to DeNicola, Jr. et al. Suitable polypropylene-polystyrene graft copolymers are also commercially available as, for example, P1045H1 and P1085H1 from Basell.

The polymeric compatibilizer is present in an amount of 2 to 30 weight percent, with respect to the total weight of the composition. Within this range the polymeric compatibilizer may be present in an amount greater than or equal to 4 weight percent, or, more specifically, greater than or equal to 6 weight percent with respect to the total weight of the composition. Also within this range the polymeric compatibilizer may be present in an amount less than or equal to 18, or, more specifically, less than or equal to 16, or, even more specifically, less than or equal to 14 weight percent with respect to the total weight of the composition.

Exemplary flame retardants include melamine (CAS No. 108-78-1), melamine cyanurate (CAS No. 37640-57-6), melamine phosphate (CAS No. 20208-95-1), melamine pyrophosphate (CAS No. 15541-60-3), melamine polyphosphate (CAS# 218768-84-4), melam, melem, melon, zinc borate (CAS No. 1332-07-6), boron phosphate, red phosphorous (CAS No. 7723-14-0), organophosphate esters, monoammonium phosphate (CAS No. 7722-76-1), diammonium phosphate (CAS No. 7783-28-0), alkyl phosphonates (CAS No. 78-38-6 and 78-40-0), metal dialkyl phosphinate, ammonium polyphosphates (CAS No. 68333-79-9), low melting glasses and combinations of two or more of the foregoing flame retardants.

Exemplary organophosphate ester flame retardants include, but are not limited to, phosphate esters comprising phenyl groups, substituted phenyl groups, or a combination of phenyl groups and substituted phenyl groups, bis-aryl phosphate esters based upon resorcinol such as, for example, resorcinol bis-diphenylphosphate, as well as those based upon bis-phenols such as, for example, bis-phenol A bis-diphenylphosphate. In one embodiment, the organophosphate ester is selected from tris(alkylphenyl) phosphate (for example, CAS No. 89492-23-9 or CAS No. 78-33-1), resorcinol bis-diphenylphosphate (for example, CAS No. 57583-54-7), bis-phenol A bis-diphenylphosphate (for example, CAS No. 181028-79-5), triphenyl phosphate (for example, CAS No. 115-86-6), tris(isopropylphenyl) phosphate (for example, CAS No. 68937-41-7) and mixtures of two or more of the foregoing organophosphate esters.

In one embodiment the organophosphate ester comprises a bis-aryl phosphate of Formula III:

(III)

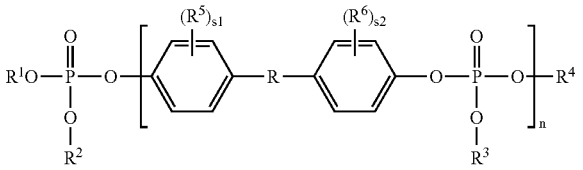

wherein R, $R^5$ and $R^6$ are independently at each occurrence an alkyl group having 1 to 5 carbons and $R^1$–$R^4$ are independently an alkyl, aryl, arylalkyl or alkylaryl group having 1 to 10 carbons; n is an integer equal to 1 to 25; and s1 and s2 are independently an integer equal to 0 to 2. In some embodiments $OR^1$, $OR^2$, $OR^3$ and $OR^4$ are independently derived from phenol, a monoalkylphenol, a dialkylphenol or a trialkylphenol.

As readily appreciated by one of ordinary skill in the art, the bis-aryl phosphate is derived from a bisphenol. Exemplary bisphenols include 2,2-bis(4-hydroxyphenyl)propane (so-called bisphenol A), 2,2-bis(4-hydroxy-3-methylphenyl) propane, bis(4-hydroxyphenyl)methane, bis(4-hydroxy-3,5-dimethylphenyl)methane and 1,1-bis(4-hydroxyphenyl) ethane. In one embodiment, the bisphenol comprises bisphenol A.

Organophosphate esters can have differing molecular weights making the determination of the amount of different organophosphate esters used in the thermoplastic composition difficult. In one embodiment the amount of phosphorus, as the result of the organophosphate ester, is 0.8 weight percent to 1.2 weight percent with respect to the total weight of the composition.

The amount of the flame retardant, when present in the thermoplastic composition, is sufficient for the covered conductor to pass the relevant flame retardance standard to the type of covered conductor. For example, when the covered conductor is an electrical wire the amount of flame retardant is sufficient for the electrical wire to have a flame out time less than or equal to 70 seconds, when tested according to the flame propagation procedure contained in ISO 6722.

In one embodiment, the flame retardant comprises an organophosphate ester present in an amount of 5 to 18 weight percent (wt. %), with respect to the total weight of the composition. Within this range the amount of organophosphate ester can be greater than or equal to 7 wt. %, or more specifically, greater than or equal to 9 wt. %. Also within this range the amount of organophosphate ester can be less than or equal to 16 wt. %, or, more specifically, less than or equal to 14 wt. %.

Additionally, the composition may optionally also contain various additives, such as antioxidants; fillers and reinforcing agents having an average particle size less than or equal to 10 micrometers, such as, for example, silicates, $TiO_2$, fibers, glass fibers, glass spheres, calcium carbonate, talc, and mica; mold release agents; UV absorbers; stabilizers such as light stabilizers and others; lubricants; plasticizers; pigments; dyes; colorants; anti-static agents; foaming agents; blowing agents; metal deactivators, and combinations comprising one or more of the foregoing additives.

The thermoplastic composition, covering and covered conductor are further illustrated by the following non-limiting examples.

EXAMPLES

The following examples were prepared using the materials listed in Table 2.

TABLE 2

| Component | Description |
|---|---|
| PPE | A poly(2,6-dimethylphenylene ether) with an intrinsic viscosity of 0.46 dl/g as measured in chloroform at 25° C. commercially available from General Electric under the grade name PPO646. |
| KG1650 | A polyphenylethylene-poly(ethylene/butylene)-polyphenylethylene block copolymer having a phenylethylene content of 30 weight percent, based on the total weight of the block copolymer and commercially available from KRATON Polymers under the grade name G 1650. |

TABLE 2-continued

| Component | Description |
|---|---|
| PP | A polypropylene having a melt flow rate of 1.5 g/10 min determined according to ASTM D1238 as described above and commercially available under the tradename D-015-C from Sunoco Chemicals |
| Tuftec H1043 | A polyphenylethylene-poly(ethylene/butylene)-polyphenylethylene block copolymer having a phenylethylene content of 67 weight percent, based on the total weight of the block copolymer and commercially available from Asahi Chemical. |
| BPADP | bis-phenol A bis-diphenylphosphate (CAS 181028-79-5) |

The thermoplastic composition was made by melt mixing the components in a twin screw extruder. The PPE and block copolymers were added at the feedthroat and the PP was added downstream in a second opening in the extruder. The organophosphate ester was added by a liquid injector in the second half of the extruder. The composition was produced without a filter (no mesh) and melt filtered using one or two filters with differing opening sizes as shown in Tables 4 and 5. The material was pelletized at the end of the extruder using strand pelletization. The composition is shown in Table 3.

The thermoplastic compositions were dried at 80° C. for 3–4 hours prior to extrusion with the conductor to form the covering disposed over the conductor. The conductor was a copper wire with a conductor size of 0.2 square millimeters ($mm^2$). Electrical wires were produced using a line speed of 250 meters per minute. The thermoplastic composition was preheated at 100° C. and extruded onto the conductor at 275° C. without a filter (no mesh) or melt filtered using a filter with an opening size (in micrometers) as shown in Tables 4 and 5. The insulating coverings had thicknesses of 0.2 millimeters (Table 4) and 0.15 millimeters (Table 5). The electrical wire was tested for spark leaks using 5 kilovolts (KV) over a length of 1250 meters using a high frequency AC spark tester, Model No. HF-ISA/BD-12 available from The Clinton Instrument Company, Clinton Conn. The number of spark leaks for each set of manufacturing conditions is shown in Tables 4 and 5.

TABLE 3

| | Weight percent, based on the total weight of PPE, PP, KG1650, Tuftec H1043 and BPADP |
|---|---|
| PPE | 52 |
| PP | 29 |
| KG 1650 | 5 |
| Tuftec H1043 | 5 |
| BPADP | 9 |

TABLE 4

| | Compounding filter | | |
|---|---|---|---|
| Extrusion filter | no filter | 100 | 40 |
| no filter | 8* | 0 | 1 |
| 250 | 4 | 0 | 2 |
| 74 | 0 | 0 | 0 |

*comparative example

TABLE 5

| | Compounding filter | | |
|---|---|---|---|
| Extrusion filter | no filter | 100 | 40 |
| no filter | 133* | 7 | 6 |
| 250 | 64 | 4 | 7 |
| 74 | 70 | 0 | 4 |

*comparative example

As can be seen from Tables 4 and 5 filtering during melt mixing, during extrusion coating, or during melt mixing and extrusion coating, is essential to producing electrical wire with few or no spark leaks, particularly as the thickness of the covering decreases.

While the invention has been described with reference to a several embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

All cited patents, patent applications, and other references are incorporated herein by reference in their entirety.

The invention claimed is:

1. A covering comprising a thermoplastic composition wherein the thermoplastic composition comprises:

(i) a poly(arylene ether);

(ii) a polyolefin; and (iii) a polymeric compatibilizer, and further wherein an electrical wire comprising the covering disposed over a conductor has less than or equal to 5 spark leaks for 2,500 to 15,500 meters of wire.

2. The covering of claim 1, wherein the conductor comprises a single strand or a plurality of strands.

3. The covering of claim 1, wherein the polyolefin is selected from the group consisting of polypropylene, high density polyethylene and combinations of polypropylene and high density polyethylene.

4. The covering of claim 1, wherein the polymeric compatibilizer comprises a block copolymer having a block that is a controlled distribution copolymer.

5. The covering of claim 1, wherein the polymeric compatibilizer comprises a first block copolymer having an aryl alkylene content greater than or equal to 50 weight percent based on the total weight of the first block copolymer and a second block copolymer having an aryl alkylene content less than or equal to 50 weight percent based on the total weight of the second block copolymer.

6. The covering of claim 1, wherein the polymeric compatibilizer comprises a diblock copolymer and a triblock copolymer.

7. The covering of claim 1, wherein the polymeric compatibilizer comprises a polypropylene-polystyrene graft copolymer.

8. The covering of claim 1, wherein the thermoplastic composition further comprises a flame retardant.

9. The covering of claim 1, wherein the thermoplastic composition comprises polyolefin in an amount by weight that is less than the amount of poly(arylene ether) by weight, based on the combined weight of polyolefin and poly (arylene ether).

10. A covering comprising a thermoplastic composition wherein the thermoplastic composition comprises:

(i) a poly(arylene ether);

(ii) a polyolefin; and (iii) a polymeric compatibilizer, wherein the thermoplastic composition is substantially free of visible particulate impurities.

11. The covering of claim 10, wherein the polyolefin is selected from the group consisting of polypropylene, high density polyethylene and combinations of polypropylene and high density polyethylene.

12. The covering of claim 10, wherein the polymeric compatibilizer comprises a block copolymer having a block that is a controlled distribution copolymer.

13. The covering of claim 10, wherein the polymeric compatibilizer comprises a first block copolymer having an aryl alkylene content greater than or equal to 50 weight percent based on the total weight of the first block copolymer and a second block copolymer having an aryl alkylene content less than or equal to 50 weight percent based on the total weight of the second block copolymer.

14. The covering of claim 10, wherein the polymeric compatibilizer comprises a diblock copolymer and a triblock copolymer.

15. The covering of claim 10, wherein the polymeric compatibilizer comprises a polypropylene-polystyrene graft copolymer.

16. The covering of claim 10, wherein the thermoplastic composition further comprises a flame retardant.

17. The covering of claim 10, wherein the thermoplastic composition comprises polyolefin in an amount by weight that is less than the amount of poly(arylene ether) by weight, based on the combined weight of polyolefin and poly (arylene ether).

18. A covering for a conductor wherein the covering comprises a thermoplastic composition produced by a method comprising:

melt mixing a poly(arylene ether), a polyolefin, and a polymeric compatibilizer to form a mixture;

melt filtering the mixture through a filter.

19. The covering of claim 18, wherein the polyolefin is selected from the group consisting of polypropylene, high density polyethylene and combinations of polypropylene and high density polyethylene.

20. The covering of claim 18, wherein the polymeric compatibilizer comprises a block copolymer having a block that is a controlled distribution copolymer.

21. The covering of claim 18, wherein the polymeric compatibilizer comprises a first block copolymer having an aryl alkylene content greater than or equal to 50 weight percent based on the total weight of the first block copolymer and a second block copolymer having an aryl alkylene content less than or equal to 50 weight percent based on the total weight of the second block copolymer.

22. The covering of claim 18, wherein the polymeric compatibilizer comprises a diblock copolymer and a triblock copolymer.

23. The covering of claim 18, wherein the polymeric compatibilizer comprises a polypropylene-polystyrene graft copolymer.

24. The covering of claim 18, wherein the thermoplastic composition further comprises a flame retardant.

25. The covering of claim 18, wherein the thermoplastic composition comprises polyolefin in an amount by weight that is less than the amount of poly(arylene ether) by weight, based on the combined weight of polyolefin and poly (arylene ether).

26. The covering of claim 18, wherein the covering has a thickness and the filter has openings having a maximum diameter that is less than or equal to half the covering thickness.

27. A covering for a conductor wherein the covering comprises a thermoplastic composition produced by a method comprising:

melt mixing a poly(arylene ether), a polyolefin, and a polymeric compatibilizer to form a first mixture;

melt filtering the first mixture through a first filter;

melt filtering the first filtered mixture through a second filter to form a second filtered mixture.

28. The covering of claim 27 wherein the first filter has openings with diameters of 20 micrometers to 150 micrometers.

29. The covering of claim 27 wherein the second filter has openings with diameters of 20 micrometers to 150 micrometers.

30. The covering of claim 27 wherein the covering has a thickness and the first filter has openings having a maximum diameter that is less than or equal to half the covering thickness.

31. The covering of claim 27 wherein the covering has a thickness and the second filter has openings having a maximum diameter that is less than or equal to half the covering thickness.

* * * * *